US006004165A

United States Patent [19]

Dinh et al.

[11] Patent Number: 6,004,165

[45] Date of Patent: Dec. 21, 1999

[54] MULTIPLE CABLE CONNECTOR AND METHOD THEREFOR

[75] Inventors: Cong Thanh Dinh, Memphis; Mark R. Drane, Germantown, both of Tenn.

[73] Assignee: Thomas & Betts International, Sparks, Nev.

[21] Appl. No.: 09/188,036

[22] Filed: Nov. 6, 1998

[51] Int. Cl.[6] ..... H01R 4/50

[52] U.S. Cl. ..... 439/783; 439/782; 439/863

[58] Field of Search ..... 439/783, 775, 439/786, 790; 174/84 C, 84 R, 84 S, 40 CC, 94 R, 94 S, 135

[56] References Cited

U.S. PATENT DOCUMENTS

| | | | |
|---|---|---|---|
| 568,802 | 10/1896 | Seaman . | |
| 600,636 | 3/1898 | Curry . | |
| 667,530 | 2/1901 | Johnson . | |
| 788,357 | 4/1905 | Hulsey . | |
| 1,278,785 | 9/1918 | Tainter | 439/863 |
| 1,888,342 | 11/1932 | Anderson . | |
| 2,106,724 | 2/1938 | Cope . | |
| 2,450,147 | 9/1948 | Lawry . | |
| 2,469,257 | 5/1949 | Brickman . | |
| 2,814,025 | 11/1957 | Wade et al. . | |
| 2,828,147 | 3/1958 | Peiffer . | |
| 3,065,449 | 11/1962 | Matthysse et al. . | |
| 3,275,974 | 9/1966 | Mixon, Jr. . | |
| 3,329,928 | 7/1967 | Brokse . | |
| 3,349,167 | 10/1967 | Wahl . | |
| 3,462,543 | 8/1969 | Wahl et al. . | |
| 3,504,332 | 3/1970 | Mixon, Jr. . | |
| 3,516,050 | 6/1970 | Mixon, Jr. et al. . | |
| 3,588,791 | 6/1971 | Polidori . | |
| 3,920,310 | 11/1975 | Walsh et al. . | |
| 4,059,333 | 11/1977 | Mixon, Jr. . | |
| 4,533,205 | 8/1985 | Frank . | |
| 4,600,264 | 7/1986 | Counsel . | |
| 4,634,205 | 1/1987 | Gemra . | |
| 4,650,273 | 3/1987 | Roosdrop . | |
| 4,723,920 | 2/1988 | Werner . | |
| 4,730,087 | 3/1988 | Werner . | |
| 4,734,062 | 3/1988 | Goto . | |
| 4,813,894 | 3/1989 | Mixon, Jr. . | |
| 4,863,403 | 9/1989 | Shannon . | |
| 4,872,856 | 10/1989 | Pooley et al. . | |
| 4,915,653 | 4/1990 | Mair . | |
| 5,006,081 | 4/1991 | Counsel et al. . | |
| 5,044,996 | 9/1991 | Goto . | |
| 5,145,420 | 9/1992 | Counsel et al. . | |
| 5,151,560 | 9/1992 | Kreinberg et al. . | |
| 5,244,422 | 9/1993 | Laricchia . | |
| 5,538,446 | 7/1996 | Diniz et al. . | |
| 5,538,447 | 7/1996 | Chadbourne et al. . | |
| 5,539,152 | 7/1996 | Gretz . | |
| 5,774,987 | 7/1998 | Chadbourne et al. . | |
| 5,794,334 | 8/1998 | Chadbourne et al. . | |

OTHER PUBLICATIONS

AMP Catalog 82913, Rev. Apr. 1993, "C–LOK Grounding and Bonding Connectors".

*Primary Examiner*—Steven L. Stephan
*Assistant Examiner*—Son V. Nguyen
*Attorney, Agent, or Firm*—G. Andrew Barger

[57] ABSTRACT

A multiple cable connector and method for electrically connecting and mechanically securing a first cable to a second cable. The connector includes a C-shaped member having a flange disposed therein, a first channel, and a second channel parallel to the first channel and spaced apart therefrom. The first and second channels are inwardly facing and connected by a web extending therebetween. An F-shaped member is also included in the cable connector that has a first arm for retaining the first cable within the first channel, a second arm for retaining the second cable within the second channel, and a projection for engaging the flange when the F-shaped member is press fit into the C-shaped member.

14 Claims, 4 Drawing Sheets

MULTIPLE CABLE CONNECTOR AND METHOD THEREFOR

FIELD OF THE INVENTION

In general, the present invention relates to cable connectors and, in particular, the present invention relates to a multiple cable connector and method for electrically connecting and mechanically securing a first cable to a second cable of differing or same diameter.

BACKGROUND

For many years the electrical cable industry has sought relief for the often recurring problem of electrically connecting and mechanically securing a first cable to a second cable. This has been most readily the case near telephone poles when a cable running between poles must be secured to a grounded cable, which extends downward and is connected to a buried grounding rod. Prior patents have approached this problem by securing the cables in a metal member and then driving a wedge into the metal member, thereby securing the cables between the wedge and the member. These patents typically require the use of a hammer around electrical lines and have proven very difficult to remove the wedge from the cables.

SUMMARY OF THE INVENTION

The present invention eliminates the above difficulties and disadvantages by providing a multiple cable connector and method for electrically connecting and mechanically securing a first cable to a second cable of differing diameter. The connector includes a C-shaped member having a flange disposed therein, a first channel, and a second channel parallel to the first channel and spaced apart therefrom. The first and second channels are inwardly facing and connected by a web extending therebetween. An F-shaped member is also included in the cable connector that has a first arm for retaining the first cable within the first channel, a second arm for retaining the second cable within the second channel, and a projection for engaging the flange when the F-shaped member is press fit into the C-shaped member.

One advantage of the present invention is that the first arm includes a groove disposed therein for abutting against the first cable. The second arm includes a convex portion defined thereon for abutting against the second cable. Moreover, the first channel includes at least one first inner tooth projecting toward the first cable and the second channel includes at least one second inner tooth projecting toward the second cable.

A further advantage is that the C-shaped member has a first end including the flange and a second end having at least one tooth for gripping while the F-shaped member is press fit into the C-shaped member for electrically connecting and mechanically securing the first cable to the second cable. At least one first gripping projections 40 is formed on the web of the C-shaped member for gripping while the F-shaped member is press fit into the C-shaped member for electrically connecting and mechanically securing the first cable to the second cable, which can be of differing diameter from the first cable.

Another advantage is that at least one second gripping projection is formed on the F-shaped member for gripping while the F-shaped member is press fit into the C-shaped member for electrically connecting and mechanically securing the first cable to the second cable. Also, an aperture is formed between the first and second arms for receiving a tapered pin therein to further force the first and second arms against the first and second cables, respectively. A swing arm is formed between the first and second arms such that when the swing arm is generally orthogonal to the first and second arms, the first and second arms are further forced against the first and second cables, respectively.

A method is also provided in the present invention for electrically connecting and mechanically securing a first cable to a second cable of differing diameter via a C-shaped member and an F-shaped member. The method comprises the acts of placing the second cable on a second channel of the C-shaped member and clamping the second cable into the second channel such that the second cable is held therein. The first cable is then placed on a first channel of the C-shaped member and the first cable is clamped into the first channel such that the first cable is held therein. Subsequently, the F-shaped member is inserted into the C-shaped member and the F-shaped member is press fit into the C-shaped member such that a projection on the F-shaped member catches a flange disposed on the C-shaped member.

DETAILED DESCRIPTION OF THE PREFERRED EMBODIMENTS

Figure 1:
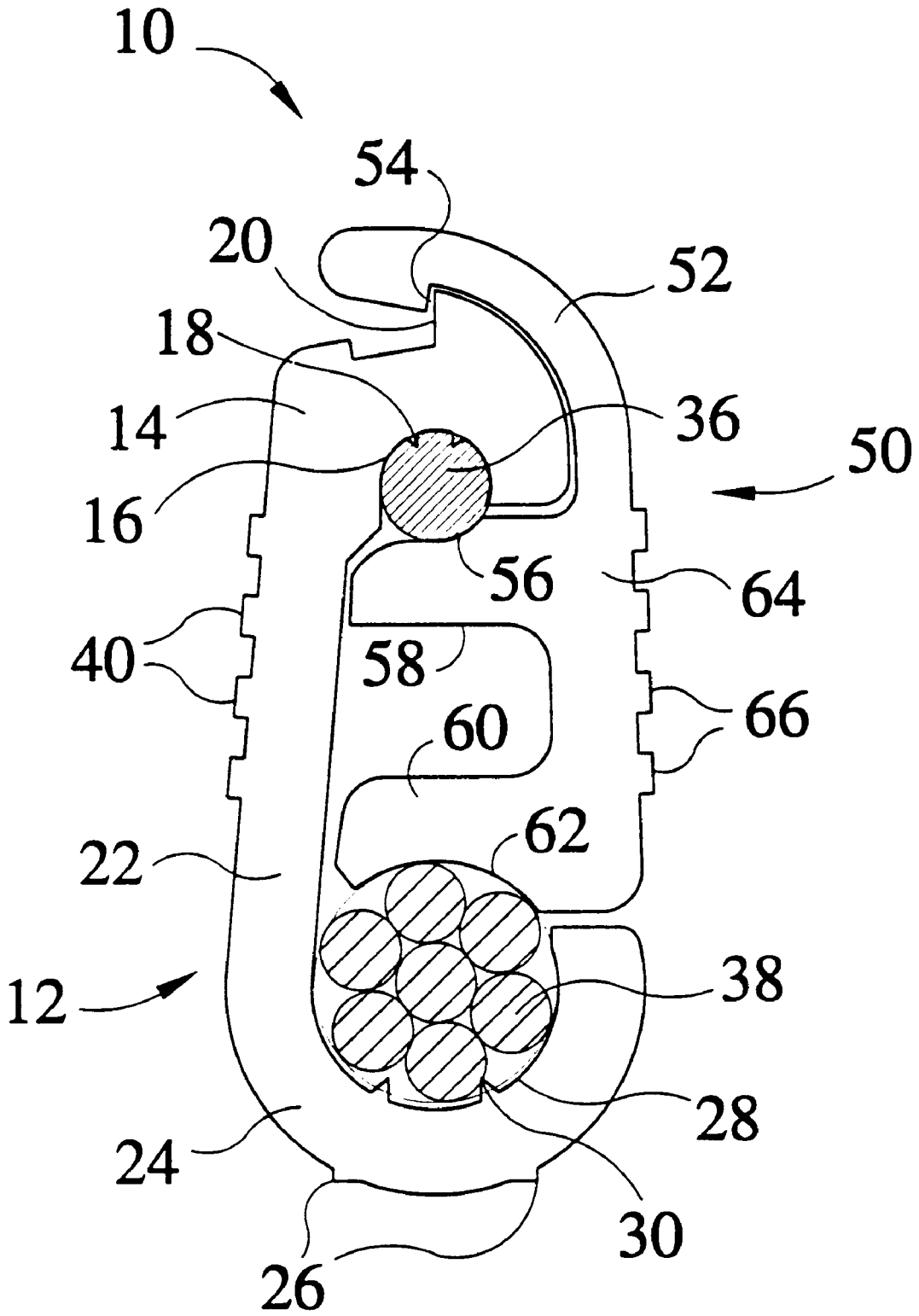
FIG. 1 is a side elevational view of a multiple cable connector showing an F-shaped member inserted into a C-shaped member of the present invention.

The above and other features, aspects, and advantages of the present invention will now be discussed in the following detailed description and appended claims, which are to be considered in conjunction with the accompanying drawings in which identical reference characters designate like elements throughout the views. Shown in FIG. 1 is a multiple cable connector 10 for electrically connecting and mechanically securing a first cable 36 to a second cable 38, such as a steel telephone pole strand to a copper wire that is grounded. A particular advantage of the present cable connector is that the first cable 36 and the second cable 38 can be of differing or the same diameter. Because the first cable 36 is preferably grounded, when the second cable 38 is mechanically and electrically thereto by the cable connector. Moreover, the cable connector is preferably constructed of aluminum but could be constructed of another non-corrosive metal such as stainless steel.

As shown in FIGS. 1–12, the connector includes a C-shaped member 12 that includes a first end 14 with a flange 20 disposed therein and a second end 24. A first channel 16 is formed in the first end 14, and a second channel 28 formed the second end 24, parallel to the first channel 16 and spaced apart therefrom. The first and second channels are inwardly facing and connected by a web 22 extending therebetween. The first channel 16 includes at least one first inner tooth, but preferably first inner teeth 18, projecting toward the first cable 36. Because the first cable 36, when constructed of copper, is more malleable than the aluminum first inner teeth 18, the first cable 36 will be penetrated by the first inner teeth 18 thereby helping to retain the first cable 36 within the first channel 16. The second channel 28 includes at least one second inner tooth, but preferably second inner teeth 30, projecting toward the second cable 38. Because the second cable 38 can be of steel strands, the aluminum second inner teeth 30 deform about the second cable 38 creating a press-fit pressure thereby helping to retain the second cable 38 within the second channel 28.

As is best shown in FIGS. 1, 6–9, the multiple cable connector 10 further includes a second member that is preferably an F-shaped member 50, which has a first arm 58 for retaining the first cable 36 within the first channel 16. The F-shaped member 50 further includes a groove 56 disposed therein for abutting against the first cable 36 and on which the first cable 36 is seated when in the first channel 16. A second arm 60 is also provided in the F-shaped member 50 for retaining the second cable 38 within the second channel 28 and includes a convex portion 62 defined thereon for abutting against the second cable 38. A projection 54 is also included for engaging the flange 20 when the F-shaped member 50 is press fit into the C-shaped member 12, as shown in FIGS. 7–12.

Figure 3:
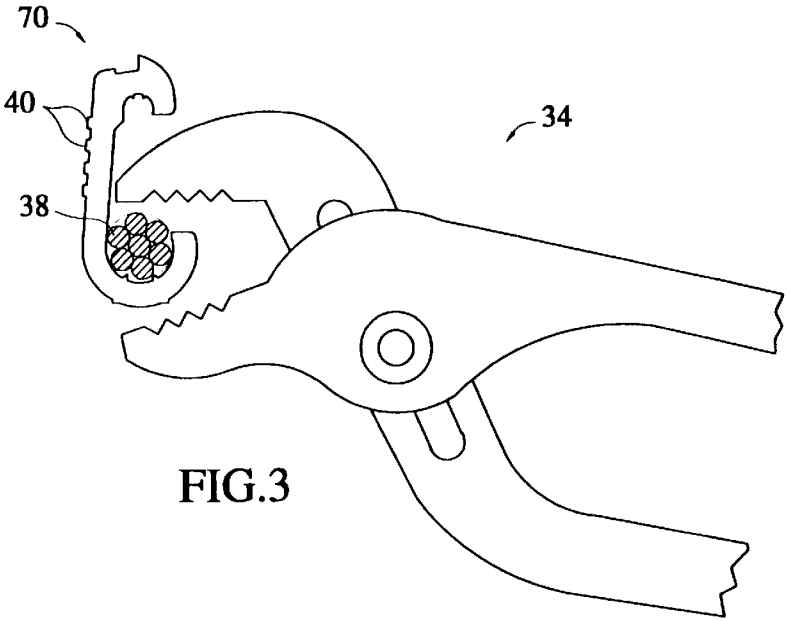
FIG. 3 is a side elevational view of the act of the cable being clamped on the channel of the C-shaped member of the present invention.
Figure 5:
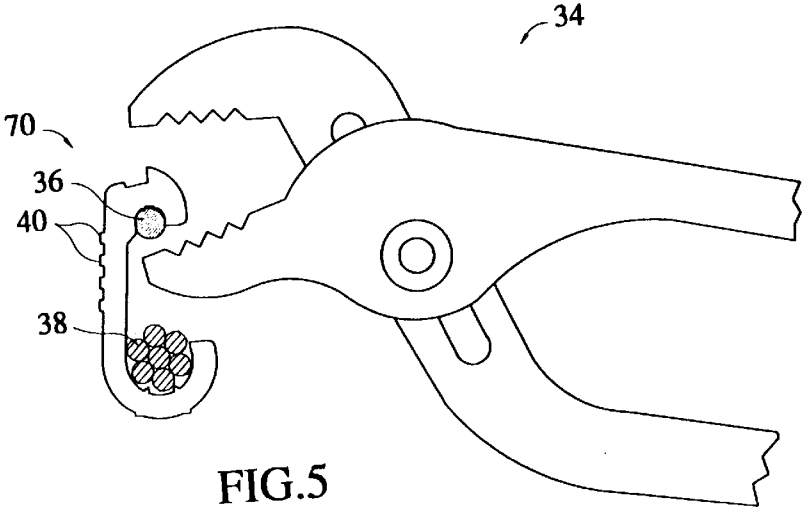
FIG. 5 is a side elevational view of the act of the cable being clamped on the other channel of the C-shaped member of the present invention.
Figure 7:
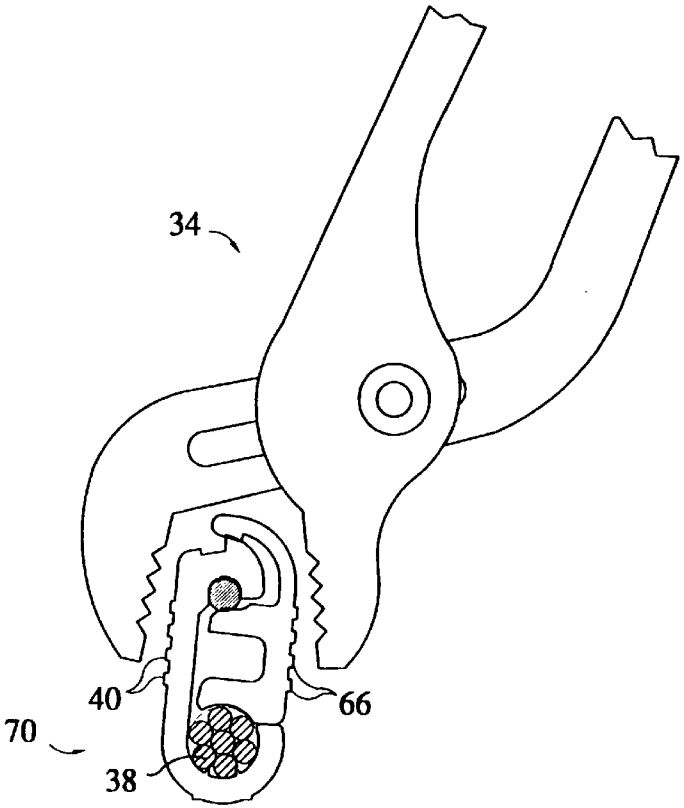
FIG. 7 is a side elevational view of the act of the F-shaped member being clamped into the C-shaped member of the present invention.

As best shown in FIG. 3, the C-shaped member 12 has at least one tooth disposed on the second end 24, but preferably a plurality of outer teeth 26 for gripping by pliers 34 or other clamping tool when the second cable 38 is clamped into the second channel 28. The flange 20 can also be used for gripping by the pliers 34 when the first cable 36 is being clamped into the first channel 16, as shown in FIG. 5. At least one first gripping projection 40 is formed on the web 22 for gripping, which is preferably done by pliers 34, as shown in FIG. 7, but could also be any other clamping tool, while the F-shaped member 50 is press fit into the C-shaped member 12 for electrically connecting and mechanically securing the first cable 36 to the first cable 36. Similarly, at least one second gripping projection 66 is formed on the F-shaped member 50 for gripping while the F-shaped member 50 is press fit into the C-shaped member 12 for electrically connecting and mechanically securing the first cable 36 to the second cable 38.

Figure 10:
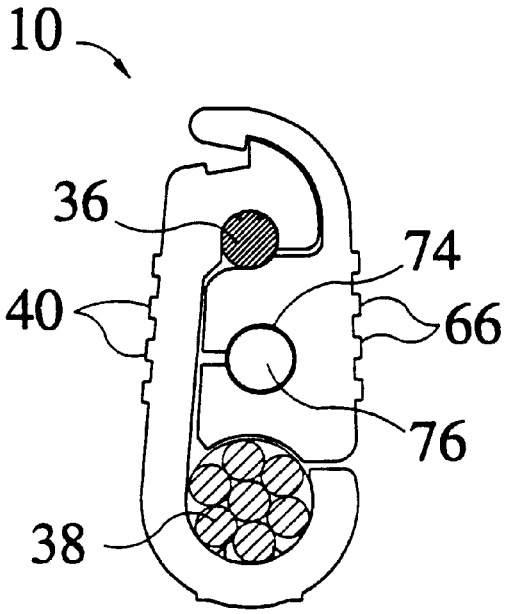
FIG. 10 is a side elevational view of another embodiment of the multiple cable connector showing the F-shaped member inserted into the C-shaped member of the present invention.
Figure 11:
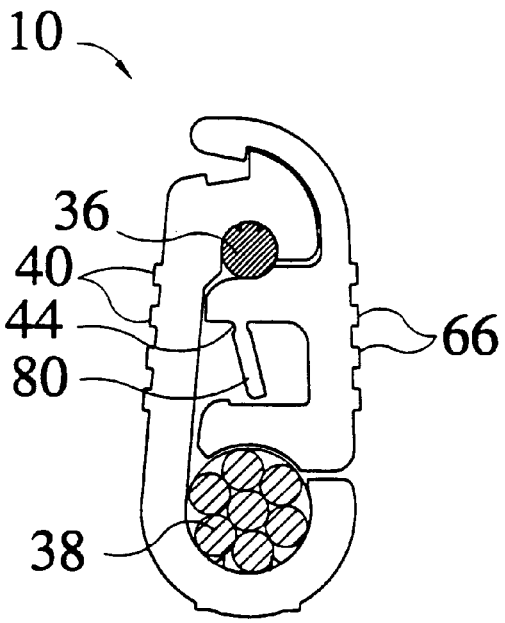
FIG. 11 is a side elevational view of a further embodiment of the multiple cable connector showing the F-shaped member inserted into the C-shaped member of the present invention.
Figure 12:
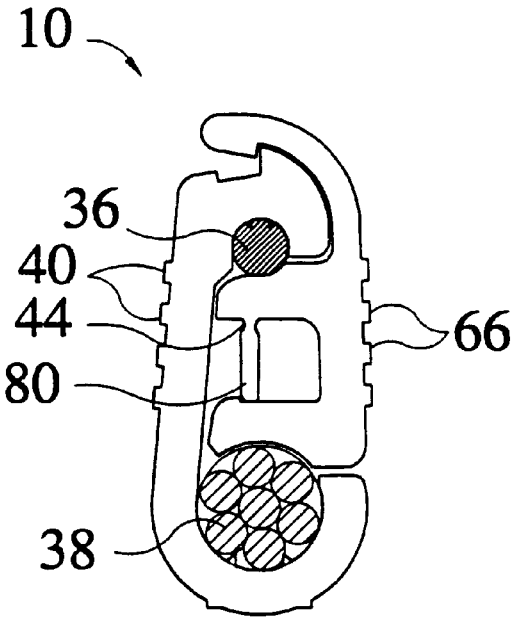
FIG. 12 is a side elevational view of the embodiment of FIG. 11 showing the F-shaped member inserted into the C-shaped member of the present invention with a swing arm in a closed position.

In one embodiment of the present cable connector as shown in FIG. 10, an aperture 74 is formed between the first arm 58 and second arm 60 for receiving a tapered pin 76 therein to further force or bias the first arm 58 and second arm 60 against the first cable 36 and second cable 38, respectively. The tapered pin 76 is also preferably constructed of a non-corrosive metal such as aluminum or stainless steel. In another embodiment, as shown in FIGS. 11 and 12, a swing arm 80 is formed between the first and second arms such that when the swing arm 80 is generally orthogonal to the first and second arms, the first and second arms are further forced or biased against the first and second cables, respectively.

Figure 2:
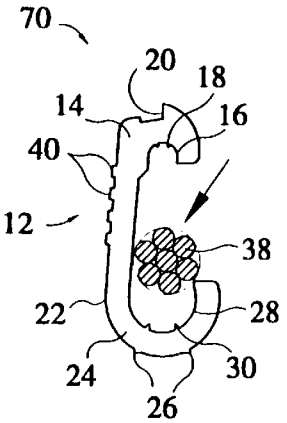
FIG. 2 is a side elevational view of the act of a cable being placed on a channel of the C-shaped member of the present invention.
Figure 4:
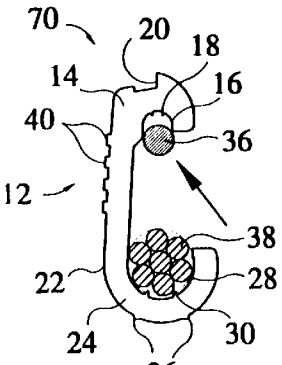
FIG. 4 is a side elevational view of the act of a cable being placed on another channel of the C-shaped member of the present invention.

The present invention further includes a method 70 for electrically connecting and mechanically securing the first cable 36 to the second cable 38 via the C-shaped member 12 and the F-shaped member 50. As shown in FIGS. 2 and 3, the method 70 includes the acts of placing the second cable 38 on a second channel 28 of the C-shaped member 12 and clamping the second cable 38 into the second channel 28, via the pliers 34, such that the second cable 38 is held therein. The first cable 36 is then placed on or over the first channel 16 of the C-shaped member 12, as shown in FIG. 4.

Figure 6:
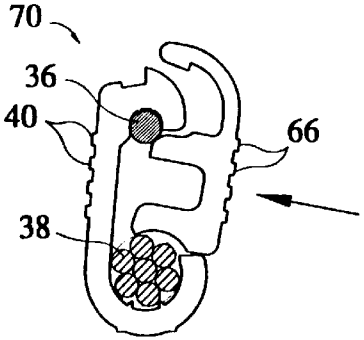
FIG. 6 is a side elevational view of the act of the F-shaped member being inserted into the C-shaped member of the present invention.
Figure 8:
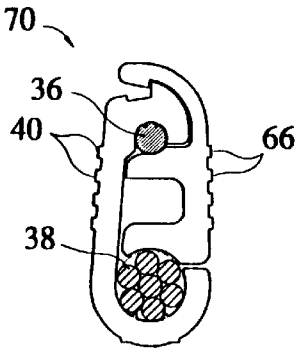
FIG. 8 is a side elevational view of the act of the F-shaped member inserted into the C-shaped member of the present invention.

Subsequently, the first cable 36 is clamped into the first channel 16 such that the first cable 36 is held therein, as shown in FIG. 5. The F-shaped member 50 is subsequently inserted into the C-shaped member 12, as shown in FIG. 6. The F-shaped member 50 is then press fit into the C-shaped member 12 such that the projection 54 on the F-shaped member 50 catches the flange 20 disposed on the C-shaped member 12, as is best shown in FIGS. 7 and 8.

Figure 9:
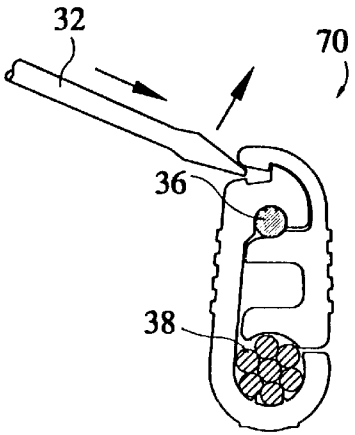
FIG. 9 is a side elevational view of the act of the F-shaped member being removed from the C-shaped member of the present invention.

As shown in FIG. 9, the method 70 also includes the act of prying the projection 54 from the flange 20 of the C-shaped member 12 to release the F-shaped member 50 from the C-shaped member 12. Preferably, and as discussed above, the F-shaped member 50 has a first arm 58 for retaining the first cable 36 within the first channel 16 and a second arm 60 for retaining the second cable 38 within the second channel 28. Further, the C-shaped member 12 has at least one tooth and at least one first gripping projection 40 disposed thereon for gripping while the F-shaped member 50 is press fit into the C-shaped member 12 for electrically connecting and mechanically securing the first cable 36 to the second cable 38.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above mentioned description is to be considered exemplary, rather than limiting, and the true scope of the invention is that defined in the following claims.

What is claimed is:

1. A multiple cable connector for electrically connecting and mechanically securing a first cable to a second cable, the connector comprising:

a first member having a flange disposed therein, a first channel and a second channel parallel to the first channel and spaced apart therefrom, the first and second channels being inwardly facing and connected by a web extending therebetween;

a second member having a first arm for retaining the first cable within the first channel, a second arm for retaining the second cable within the second channel, and a projection for engaging the flange when the second member is press fit into the first member; and wherein the first member has a first end including the flange and a second end having at least one tooth for gripping while the second member is press fit into the first member for electrically connecting and mechanically securing the first cable to the second cable and the second channel includes at least one second inner tooth projecting toward the second cable.

2. A multiple cable connector for electrically connecting and mechanically securing a first cable to a second cable, the connector comprising:

a C-shaped member having a first end with a flange disposed therein and a second end, a first channel formed in the first end, and a second channel formed the second end, parallel to the first channel and spaced apart therefrom, the first and second channels being inwardly facing and connected by a web extending therebetween, the first channel including at least one first inner tooth projecting toward the first cable and the second channel including at least one second inner tooth projecting toward the second cable;

a F-shaped member having a first arm for retaining the first cable within the first channel and including a groove disposed therein for abutting against the first cable, a second arm for retaining the second cable within the second channel and including a convex portion defined thereon for abutting against the second cable, and a projection for engaging the flange when the F-shaped member is press fit into the C-shaped member; and wherein the C-shaped member has at least one tooth disposed on the second end and at least one first gripping projection is formed on the web for gripping while the F-shaped member is press fit into the C-shaped member for electrically connecting and mechanically securing the first cable to the second cable, and at least one second gripping projection is formed on the F-shaped member for gripping while the F-shaped member is press fit into the C-shaped member for electrically connecting and mechanically securing the first cable to the second cable.

3. The multiple cable connector of claim 2 wherein an aperture is formed between the first and second arms for receiving a tapered pin therein to further force the first and second arms against the first and second cables, respectively.

4. The multiple cable connector of claim 2 wherein a swing arm is formed between the first and second arms such that when the swing arm is generally orthogonal to the first and second arms, the first and second arms are further forced against the first and second cables, respectively.

5. The multiple cable connector of claim 2 wherein the first cable is of differing diameter than the second cable.

6. A method for electrically connecting and mechanically securing a first cable to a second cable via a C-shaped member and a F-shaped member, the method comprising the acts of:

placing the second cable on a second channel of the C-shaped member;

clamping the second cable into the second channel such that the second cable is held therein;

placing the first cable on a first channel of the C-shaped member;

clamping the first cable into the first channel such that the first cable is held therein;

inserting the F-shaped member into the C-shaped member; and press fitting the F-shaped member into the C-shaped member such that a projection on the F-shaped member catches a flange disposed on the C-shaped member.

7. The method of claim 6 further comprising the act of prying the projection from the flange of the C-shaped member to release the F-shaped member from the C-shaped member.

8. The method of claim 6 wherein the F-shaped member has a first arm for retaining the first cable within the first channel and a second arm for retaining the second cable within the second channel.

9. The method of claim 6 wherein the C-shaped member has at least one tooth and at least one first gripping projection disposed thereon for gripping while the F-shaped member is press fit into the C-shaped member for electrically connecting and mechanically securing the first cable to the second cable.

10. The method of claim 6 wherein at least one second gripping projection is formed on the F-shaped member for gripping while the F-shaped member is press fit into the C-shaped member for electrically connecting and mechanically securing the first cable to the second cable.

11. The method of claim 8 wherein an aperture is formed between the first and second arms for receiving a tapered pin therein to further force the first and second arms against the first and second cables, respectively.

12. The method of claim 8 a swing arm is formed between the first and second arms such that when the swing arm is generally orthogonal to the first and second arms, the first and second arms are further forced against the first and second cables, respectively.

13. A multiple cable connector for electrically connecting and mechanically securing a first cable to a second cable, the connector comprising:

a first member having a flange disposed therein, a first channel and a second channel parallel to the first channel and spaced apart therefrom, the first and second channels being inwardly facing and connected by a web extending therebetween;

a second member having a first arm for retaining the first cable within the first channel, a second arm for retaining the second cable within the second channel, and a projection for engaging the flange when the second member is press fit into the first member; and wherein an aperture is formed between the first and second arms for receiving a tapered pin therein to further force the first and second arms against the first and second cables, respectively.

14. A multiple cable connector for electrically connecting and mechanically securing a first cable to a second cable, the connector comprising:

a first member having a flange disposed therein, a first channel and a second channel parallel to the first channel and spaced apart therefrom, the first and second channels being inwardly facing and connected by a web extending therebetween;

a second member having a first arm for retaining the first cable within the first channel, a second arm for retaining the second cable within the second channel, and a projection for engaging the flange when the second member is press fit into the first member; and wherein a swing arm is formed between the first and second arms such that when the swing arm is generally orthogonal to the first and second arms, the first and second arms are further forced against the first and second cables, respectively.

* * * * *